US008052114B2

(12) United States Patent
Saggers

(10) Patent No.: US 8,052,114 B2
(45) Date of Patent: Nov. 8, 2011

(54) RAMP SYSTEM

(75) Inventor: Barry Saggers, Bucks (GB)

(73) Assignee: Xerox Corporation, Norwalk, CT (US)

( * ) Notice: Subject to any disclaimer, the term of this patent is extended or adjusted under 35 U.S.C. 154(b) by 365 days.

(21) Appl. No.: 12/419,747

(22) Filed: Apr. 7, 2009

(65) Prior Publication Data

US 2010/0251939 A1 Oct. 7, 2010

(51) Int. Cl.
*A47B 97/00* (2006.01)

(52) U.S. Cl. ..... 248/500; 248/346.02; 248/506; 108/55.1

(58) Field of Classification Search ..... 248/500, 248/346.02, 346.01, 506; 108/55.1, 51.11, 108/55.5

See application file for complete search history.

(56) References Cited

U.S. PATENT DOCUMENTS

| | | | | |
|---|---|---|---|---|
| 4,638,744 | A * | 1/1987 | Clive-Smith | 108/56.1 |
| 5,644,992 | A * | 7/1997 | Clive-Smith | 108/55.1 |
| 6,035,790 | A * | 3/2000 | Polando | 108/55.1 |
| 6,769,368 | B2 * | 8/2004 | Underbrink et al. | 108/55.3 |
| 7,293,508 | B2 * | 11/2007 | Johnson et al. | 108/55.1 |
| 7,448,104 | B2 * | 11/2008 | Turner | 14/69.5 |
| 7,845,894 | B2 * | 12/2010 | Dickinson et al. | 414/430 |
| 2007/0226921 | A1 * | 10/2007 | Turner | 14/71.1 |

* cited by examiner

*Primary Examiner* — Amy J. Sterling
(74) *Attorney, Agent, or Firm* — Pepper Hamilton LLP

(57) ABSTRACT

A ramp system may include a pallet configured to support a product, a ramp configured to secure the product to the pallet when the ramp is in a first position and to connect to the pallet when the ramp is in a second position and a bracket configured to be removeably connected to a top surface of the pallet.

14 Claims, 2 Drawing Sheets

RAMP SYSTEM

BACKGROUND

Cargo is often transported on pallets, which can be moved, lifted, loaded and/or the like by handling equipment. Removing cargo from a pallet may be difficult, however, as the cargo can be significantly heavy. Ramp systems for removing cargo from pallets are known in the art, however these systems usually involve components that are separate and additional to the overall packaging concept of the cargo.

SUMMARY

Before the present methods are described, it is to be understood that this invention is not limited to the particular systems, methodologies or protocols described, as these may vary. It is also to be understood that the terminology used herein is for the purpose of describing particular embodiments only, and is not intended to limit the scope of the present disclosure which will be limited only by the appended claims.

It must be noted that as used herein and in the appended claims, the singular forms "a," "an," and "the" include plural reference unless the context clearly dictates otherwise. Unless defined otherwise, all technical and scientific terms used herein have the same meanings as commonly understood by one of ordinary skill in the art. As used herein, the term "comprising" means "including, but not limited to."

In an embodiment, a ramp system may include a pallet configured to support a product, a ramp and a bracket configured to be removeably connected to a top surface of the pallet. The bracket may be configured to secure the product to the pallet when connected in a third position. The bracket may be configured to connect to the ramp when connected in a fourth position.

A ramp system may include a pallet configured to support a product, a ramp configured to secure the product to the pallet when the ramp is in a first position and to connect to the pallet when the ramp is in a second position and a bracket configured to be removeably connected to a top surface of the pallet.

A ramp system may include a pallet configured to support a product, a ramp configured to secure the product to the pallet when in a first position and to connect to the pallet when in a second position and a bracket configured to be removeably connected to a top surface of the pallet. The bracket may be configured to secure the product when connected in a third position. The bracket may be configured to connect to the ramp when connected in a fourth position.

A ramp system may include a pallet configured to support a product, a ramp configured to secure the product to the pallet when in a first position and to connect to the pallet when in a second position and a bracket configured to be removeably connected to a top surface of the pallet. The bracket may be configured to secure the product when connected in a third position. The bracket may be configured to connect to the ramp when connected in a fourth position.

BRIEF DESCRIPTION OF THE DRAWINGS

Aspects, features, benefits and advantages of the present invention will be apparent with regard to the following description and accompanying drawings, of which.

DETAILED DESCRIPTION

In an embodiment, a ramp system may include a pallet, a ramp and/or a bracket. A pallet may be a platform that may be used to support, store and/or transport cargo. For example, a pallet may be used to support, store and/or transport document production devices, processing devices and/or other products.

Figure 1:
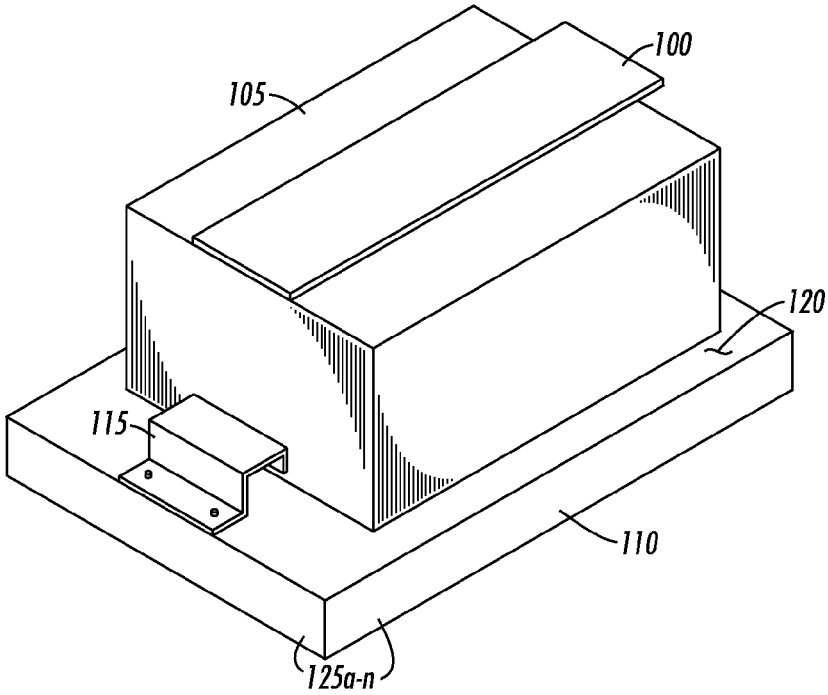
FIG. 1 illustrates an exemplary ramp system according to an embodiment.

FIG. 1 illustrates an exemplary ramp system according to an embodiment. The ramp system may include a ramp 100, a pallet 110 and a bracket 115. As illustrated by FIG. 1, a pallet 110 may have a top surface 120 and side walls 125*a*-N. The top surface 120 of the pallet 110 may support the product 105 during transport, storage and/or the like.

As illustrated by FIG. 1, a ramp 100 may be positioned on top of a product 105 during transport, storage and/or the like. In such a position, the ramp 100 may protect the product from compressive and/or impact loads during transport, storage and/or the like. In an embodiment, the ramp 100 may be removeably connected to the product 105. For example, the ramp 100 may be connected to the product 105 using one or more fastening elements such as restraining brackets, screws, bolts, nails and/or the like.

Figure 2:
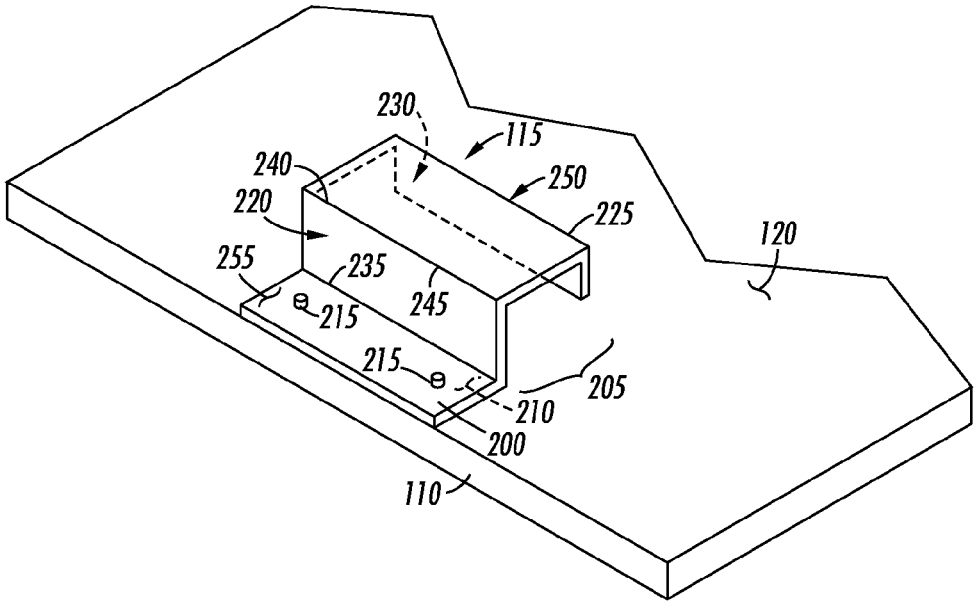
FIG. 2 illustrates an exemplary bracket according to an embodiment.

FIG. 2 illustrates a configuration of an exemplary bracket 115 that may be used during transportation and/or storage of a product 105. As illustrated by FIG. 2, a bracket 115 may have a first portion 200 and a second portion 205. In an embodiment, a second surface 210 of the first portion 200 may be secured to a top surface 120 of the pallet 110. For example, the first portion 200 may be removeably connected to the top surface 120 of the pallet 110, via the second surface 210 of the first portion 200, by one or more fastening elements 215 such as screws, bolts, nails and/or the like. In an embodiment, the second portion 205 of the bracket 115 may have a first wall 220, a connecting member 225 and a second wall 230. As illustrated by FIG. 2, the first wall 220 may be connected to an edge 235 of the first portion 200. For example, the first wall 220 may be integrally formed with the first portion 200. In an embodiment, the first wall 220 may be perpendicular to the first portion 200. In an embodiment, the first wall 220 may be perpendicular to the top surface 120 of the pallet 110.

As illustrated by FIG. 2, a first edge 240 of the connecting member 225 may be connected to a top end 245 of the first wall 220. In an embodiment, the connecting member 225 may be perpendicular to the first wall 220 and parallel to the first portion 200 and/or the top surface 120 of the pallet 110. The second wall 230 may be connected to a second edge 250 of the connecting member 225. In an embodiment, the second wall 230 may be perpendicular to the connecting member 225, parallel to the first wall 220, and/or perpendicular to the top surface 120 of the pallet 110.

In an embodiment, the bracket 115 may be used to secure the product 105 during transport and/or storage. For example, the second wall 230 of the bracket 115 may be in contact with the product 105, and may assist in preventing the product from shifting, tipping or otherwise moving on the pallet 110.

Figure 3:
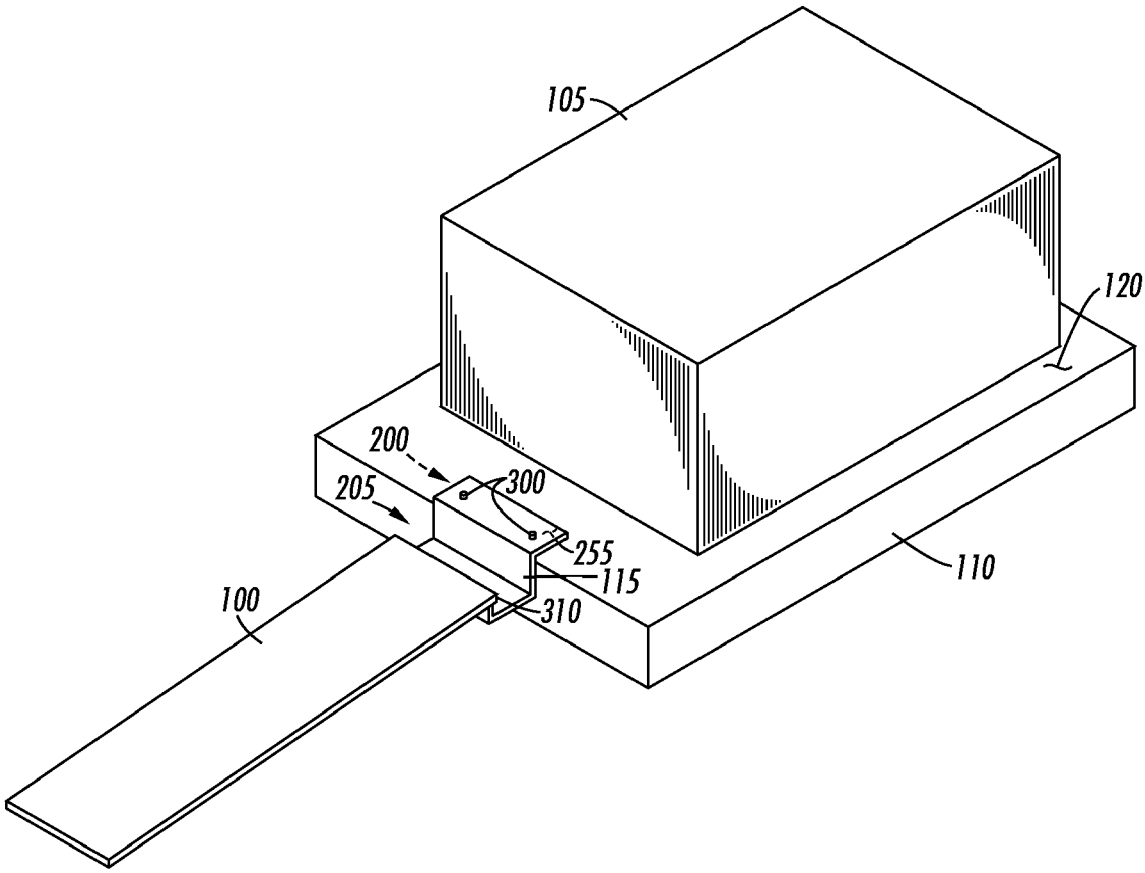
FIG. 3 illustrates an exemplary ramp system according to an embodiment.

In an embodiment, the product 105 may be removed from the pallet 110. In an embodiment, the product 105 may be removed from the pallet 110 via the ramp 100. The ramp 100 may be connected to the pallet 110 via the bracket 115. FIG. 3 illustrates a configuration of an exemplary bracket 115 that may be used to facilitate connection of the ramp 100 to the pallet 110.

As illustrated by FIG. 3, the bracket 115 may be rotated approximately 180 degrees from the configuration illustrated in FIG. 2. The first surface 255 of the first portion 200 may be secured to the pallet 110. For example, the first portion 200 may be removeably connected to the top surface 120 of the pallet 110, via the first surface 255 of the first portion 200, by one or more fastening elements 300 such as screws, bolts, nails and/or the like.

In an embodiment, the second portion 205 of the bracket 115 may extend below the top surface 120 of the pallet 110 as illustrated by FIG. 3. In an embodiment, the ramp 100 may be removed from the product 105, and may be connected to the second portion 205 of the bracket 115. For example, an end 310 of the ramp 100 may be removeably connected to the second portion 205 of the bracket 115.

In an embodiment, the product 105 may be removed from the pallet 110 via the ramp 100. For example, the product 105 may have wheels which may allow the product to be rolled off the pallet 110 and down the ramp 100. As another example, the product 105 may be pushed off the pallet 110 and down the ramp 100. In an embodiment, the ramp 100 may support a product 105 weighing approximately 260 kg or less.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A ramp system comprising:
- a pallet configured to support a product;
- a ramp configured to connect to a top portion of the product; and
- a bracket configured to be removeably connected to a top surface of the pallet, wherein the bracket is configured to secure the product to the pallet when connected in a first position, wherein the bracket is configured to connect to the ramp when connected in a second position.

2. The ramp system of claim 1, wherein the bracket comprises:
- a first portion having a first surface and a second surface, and
- a second portion comprising:
  - a first wall connected to an edge of the first portion,
  - a connecting member connected to a top portion of the first wall, and
  - a second wall connected to an edge of the connecting member.

3. The ramp system of claim 2, wherein the second surface of the first portion of the bracket is configured to be removeably secured to the pallet via one or more fastening elements.

4. The ramp system of claim 2, wherein the second wall is configured to secure the product when the bracket is connected in the first position.

5. The ramp system of claim 2, wherein the first wall is configured to be perpendicular to the first portion and to a top surface of the pallet when the bracket is connected to the top surface of the pallet.

6. The ramp system of claim 2, wherein the second wall is configured to be perpendicular to the first portion and to a top surface of the pallet when the bracket is connected to the top surface of the pallet.

7. The ramp system of claim 2, wherein the first surface of the first portion of the bracket is configured to be removeably secured to the pallet via one or more fastening elements.

8. The ramp system of claim 2, wherein a surface of the first wall is configured to be parallel to a side of the pallet when the bracket is connected to the top surface of the pallet.

9. The ramp system of claim 2, wherein the second portion of the bracket is configured to connect to an end of the ramp.

10. The ramp system of claim 1, wherein the ramp is configured to facilitate movement of the product from the pallet to another location.

11. The ramp system of claim 1, wherein the ramp is configured to support the product, wherein the product weighs approximately 260 kg or less.

12. A ramp system comprising:
- a pallet configured to support a product;
- a ramp configured to secure the product to the pallet when the ramp is in a first position and to connect to the pallet when the ramp is in a second position; and
- a bracket configured to be removeably connected to a top surface of the pallet, wherein the bracket comprises:
  - a first portion having a first surface and a second surface, and
  - a second portion comprising:
    - a first wall connected to an edge of the first portion,
    - a connecting member connected to a top portion of the first wall, and
    - a second wall connected to an edge of the connecting member.

13. The ramp system of claim 12, wherein the bracket is configured to secure the product when in a third position, wherein the bracket is configured to connect to the ramp when in a fourth position.

14. A ramp system comprising:
- a pallet configured to support a product;
- a ramp configured to secure the product to the pallet when in a first position and to connect to the pallet when in a second position; and
- a bracket configured to be removeably connected to a top surface of the pallet, wherein the bracket is configured to secure the product when connected in a third position, wherein the bracket is configured to connect to the ramp when connected in a fourth position, wherein the bracket comprises:
  - a first portion having a first surface and a second surface, and
  - a second portion comprising:
    - a first wall connected to an edge of the first portion,
    - a connecting member connected to a top portion of the first wall, and
    - a second wall connected to an edge of the connecting member.

* * * * *